US011098617B2

(12) United States Patent
Zschieschang

(10) Patent No.: US 11,098,617 B2
(45) Date of Patent: Aug. 24, 2021

(54) HYDRAULIC CAMSHAFT ADJUSTER

(71) Applicant: SCHAEFFLER TECHNOLOGIES AG & CO. KG, Herzogenaurach (DE)

(72) Inventor: Torsten Zschieschang, Hagenbüchach (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/604,640

(22) PCT Filed: Feb. 28, 2018

(86) PCT No.: PCT/DE2018/100175

§ 371 (c)(1),
(2) Date: Oct. 11, 2019

(87) PCT Pub. No.: WO2018/196904

PCT Pub. Date: Nov. 1, 2018

(65) Prior Publication Data

US 2020/0123937 A1 Apr. 23, 2020

(30) Foreign Application Priority Data

Apr. 28, 2017 (DE) ..... 102017109139.4

(51) Int. Cl.
*F01L 1/344* (2006.01)

(52) U.S. Cl.
CPC ..... *F01L 1/3442* (2013.01); *F01L 2001/3443* (2013.01); *F01L 2001/34433* (2013.01); *F01L 2001/34446* (2013.01)

(58) Field of Classification Search
CPC ..... F01L 1/3442; F01L 2001/34423; F01L 2001/34426; F01L 2001/3443; F01L 2001/34433; F01L 2001/34446; F01L 2001/3445; F01L 1/46
USPC ..... 123/90.15, 90.17
See application file for complete search history.

(56) References Cited

U.S. PATENT DOCUMENTS

| | | | | |
|---|---|---|---|---|
| 8,863,712 | B2 | 10/2014 | Schafer et al. | |
| 9,206,713 | B2 | 12/2015 | Schafer et al. | |
| 2010/0326383 | A1* | 12/2010 | Auchter | F01L 1/34 123/90.15 |

(Continued)

FOREIGN PATENT DOCUMENTS

| | | | |
|---|---|---|---|
| CN | 105358799 | A | 2/2016 |
| DE | 102007056685 | A1 | 5/2009 |
| EP | 14475828 | A2 | 8/2004 |

*Primary Examiner* — Jorge L Leon, Jr.
(74) *Attorney, Agent, or Firm* — Dickinson Wright PLLC

(57) ABSTRACT

A hydraulic camshaft adjuster for adjusting the control times of gas exchange valves of an engine is provided. A stator is rotatable synchronously with a crankshaft of the engine. A rotor is arranged so as to be rotatable relative to the stator, and is rotatable synchronously with a camshaft. A plurality of ribs are provided on the stator, dividing an annular chamber between the stator and the rotor into a plurality of pressure chambers. A rotor hub and a plurality of blades extend radially outward from the rotor hub, dividing the pressure chambers into two working chambers having different effective directions. An additional connectable pressure booster is provided at least in an effective direction of the hydraulic camshaft adjuster. The pressure booster can boost the rotor when active.

10 Claims, 5 Drawing Sheets

(56) References Cited

U.S. PATENT DOCUMENTS

| | | | | |
|---|---|---|---|---|
| 2012/0111295 | A1* | 5/2012 | Plate | F01L 1/3442 123/90.15 |
| 2012/0285406 | A1* | 11/2012 | Butterfield | F01L 1/3442 123/90.15 |
| 2016/0061064 | A1* | 3/2016 | Mukaide | F01L 1/3442 123/90.12 |
| 2016/0069226 | A1 | 3/2016 | Zschieschang | |
| 2016/0146068 | A1 | 5/2016 | Haltiner, Jr. et al. | |

* cited by examiner

HYDRAULIC CAMSHAFT ADJUSTER

CROSS-REFERENCE TO RELATED APPLICATIONS

This application is the U.S. National Phase of PCT/DE2018/100175 filed Feb. 28, 2018, which claims priority to DE 102017109139.4 filed Apr. 28, 2017, the entire disclosures of which are incorporated by reference herein.

TECHNICAL FIELD

This disclosure relates to a hydraulic camshaft adjuster and to a method for controlling a hydraulic camshaft adjuster.

BACKGROUND

Hydraulic camshaft adjusters are used with internal combustion engines in order to adapt a load state of the internal combustion engine and thus to increase the efficiency of the internal combustion engine. Hydraulic camshaft adjusters which operate on the rotary vane principle are known from the prior art. The basic construction of these camshaft adjusters generally includes a stator, which can be driven by a crankshaft of an internal combustion engine, and a rotor, which is connected to the camshaft of the internal combustion engine for conjoint rotation therewith. Provided between the stator and the rotor is an annular chamber, which is divided by radially inward-projecting projections connected to the stator for conjoint rotation therewith into a plurality of working chambers, which are each divided into two pressure chambers by a vane projecting radially outward from the rotor. Depending on the pressurization of the pressure chambers with a hydraulic pressure medium, the position of the rotor relative to the stator and hence also the position of the camshaft relative to the crankshaft can be adjusted in the "advance" or "retard" direction. Hydraulic camshaft adjusters having a central lock are known, in which, in addition to the respective end positions, the rotor can also be locked in a central position in order, in particular, to facilitate engine starting. Moreover, hydraulic camshaft adjusters which have an accumulator for the hydraulic oil as a "smart phaser" are known.

DE 10 2012 201 558 A1 discloses a hydraulic camshaft adjuster having a plurality of volume accumulators, wherein the volume accumulators are formed in cavities in the rotor. DE 10 2012 201 566 A1 discloses a hydraulic camshaft adjuster having a plurality of volume accumulators for supplying additional hydraulic oil to the working chambers of the camshaft adjuster, wherein the volume accumulators are formed in the ribs of the stator, which separate the working chambers of the camshaft adjuster from one another. In this case, check valves are provided on the volume accumulators in order to prevent uncontrolled outflow of the hydraulic oil into the working chambers of the camshaft adjuster.

As compared with conventional hydraulic camshaft adjusters, hydraulic camshaft adjusters having a volume accumulator for the pressure medium have a significantly lower pressure medium throughput and higher speeds of adjustment. A further improvement in efficiency would be possible by reducing the pressure boost. However, a significant reduction of the pressure boost has functional disadvantages, especially in the case of fully variable valve trains. Moreover, functionally reliable adjustment of the hydraulic camshaft adjuster must be ensured, even in the case of a minimum valve travel. However, since the drag torque of the camshaft relative to the change torques is very high precisely in such an operating state, a high pressure boost is required to enable the rotor to be adjusted counter to the friction and drag torques via the pump pressure. In this case, the hydraulic camshaft adjuster is designed in such a way that the maximum friction torque to be expected can be overcome with the minimum pump pressure so that in this way it is still possible to ensure adjustment counter to the drag and friction torques. This leads to relatively high oil consumption and detracts from the efficiency of the hydraulic camshaft adjuster.

DE 10 2007 056 685 A1 shows a device for the variable setting of the timings of gas exchange valves of an internal combustion engine, having an input element, an output element, at least one pressure chamber, a pressure medium supply device and at least one pressure accumulator, wherein pressure medium can be fed to or discharged from the at least one pressure chamber via the pressure medium supply device, wherein a phase position of the output element relative to the input element can be changed by the supply of pressure medium to and the outflow of pressure medium from the pressure chamber, wherein the pressure accumulator has a movable element, which is provided with a first pressure surface that partially delimits a storage chamber, wherein the storage chamber is connected or can be connected to the pressure medium supply device, wherein an energy storage device applies a force to the movable element in the direction of an initial position and wherein the movable element can be moved counter to the force of the energy storage device by pressurization of the storage chamber.

SUMMARY

It is an object of this disclosure to further improve a hydraulic camshaft adjuster embodied as a "smart phaser" having a storage volume for the pressure medium. At the same time, the hydraulic camshaft adjuster should be of even more advantageous configuration in terms of energy considerations and, in particular, should improve adjustment counter to the drag torques of the camshaft.

According to the disclosure, the object is achieved in embodiments by a hydraulic camshaft adjuster for adjusting the timings of gas exchange valves of an internal combustion engine, having a stator, which is rotatable synchronously with a crankshaft of the internal combustion engine, and a rotor, which is arranged so as to be rotatable relative to the stator and is rotatable synchronously with a camshaft. A plurality of ribs is provided on the stator, which ribs divide an annular chamber between the stator and the rotor into a plurality of pressure chambers. A rotor hub and a plurality of vanes extending radially outwardly from the rotor hub are formed on the rotor, which vanes divide the pressure chambers into two groups of working chambers, which have a different effective direction and which can each be supplied with a pressure medium flowing in or out in a pressure medium circuit. The hydraulic camshaft adjuster furthermore has a pressure medium accumulator for storing the hydraulic pressure medium. The hydraulic camshaft adjuster may have an additional selectable pressure boost at least in one effective direction, via which the pressure from the pressure boost is configured to rotate the rotor relative to the stator.

According to the disclosure, it is envisaged that the pressure boost is accomplished by the hydraulic connection of at least one further working chamber. A hydraulic pressure boost can be achieved in a particularly simple way by hydraulic connection of a working chamber.

In an embodiment, precisely one additional working chamber is supplied with pressure medium in order to bring about a higher adjusting torque on the rotor. Assuming that precisely one working chamber could already be supplied with pressure medium for adjustment without the pressure boost, the adjusting torque can be correspondingly doubled in this way. Moreover, a corresponding boost ratio can be set via the design of the hydraulic connection between the pressure medium pump and the working chamber.

As an alternative, the pressure medium pump can also have two outlets, wherein the first outlet of the pressure medium pump is connected to the working chamber for normal operation and the second outlet of the pressure medium pump is connected to the working chamber for the pressure boost. In this case, a corresponding control valve, via which the pressure medium supply can be connected to the working chamber for the pressure boost as required, must be provided on the pressure medium pump or between the pressure medium pump and the working chamber for the pressure boost.

By adding a pressure boost, the adjusting forces for adjusting the rotor can be increased as required, and therefore there is neither a need to provide the increased adjusting torque throughout the operation of the hydraulic camshaft adjuster nor a risk that adjustment will be impossible owing to an unfavorable control situation. As a result, the oil throughput through the hydraulic camshaft adjuster can be reduced, thereby reducing the energy requirement. In this way, the mechanical efficiency of the internal combustion engine associated with the camshaft adjuster can be increased.

Advantageous improvements and developments of the hydraulic camshaft adjuster indicated in the independent claim are possible via the features presented in the dependent claims.

In an embodiment, provision is made for the hydraulic camshaft adjuster to have a control valve for the joint control of the working chambers and of the selectable pressure boost. Via the control valve, it is a simple matter to add the pressure boost in order, in the case of friction torques which are possibly excessive, nevertheless to ensure adjustment of the rotor in the corresponding direction.

In an embodiment, it is envisaged that the control valve is a central valve, which is arranged in a central opening of the rotor. An already available control valve, in particular the central valve of the hydraulic camshaft adjuster, can be used to control the pressure boost. It is thus possible to dispense with an additional valve, thereby making it possible to keep down additional costs as compared with the solutions known from the prior art. In this case, the oil supply for the pressure boost can be enabled via an additional switching position at the central valve. This can be achieved, in particular, in the case of a hydraulic camshaft adjuster having a pressure medium accumulator since, by virtue of the principle involved, such hydraulic camshaft adjusters receive less pressure medium from the pressure medium pump than conventional hydraulic camshaft adjusters. In addition, there is the advantageous fact that, when the pressure boost is reduced, less volume flow of pressure medium is in any case required for the same speed of adjustment. It is therefore possible to reduce the openings in the central valve in respect of the maximum opening cross section thereof, thereby creating space for additional switching functions.

The pressure boost may bring about an adjusting force in precisely one effective direction, wherein the precisely one effective direction of the pressure boost is oriented counter to the effective direction of the drag torques of the camshaft. Owing to the camshaft drive torques acting on the rotor, an adjustment of the rotor in the "advance" direction requires a significantly higher adjusting torque than an adjustment of the rotor in the "retard" direction, in which the rotation is assisted by the drag torques. A pressure boost may therefore be provided only in the "advance" adjustment direction, thereby making it possible to reduce the design complexity of the control valve and of the oil ducts for pressure medium distribution.

In an embodiment, in a first operating state of the hydraulic camshaft adjuster, pressure medium is supplied to a first group of working chambers and, in a second operating state, which is different from the first operating state, pressure medium is supplied to the first group of working chambers and, in addition, pressure medium is supplied to an additional working chamber for the selectable pressure boost. As a result, only one or only some of the working chambers are supplied with pressure medium in normal operation, thereby making it possible to reduce the required pump power and pressure medium throughput. In the pressure-boosted mode, at least one additional working chamber is connected, thereby making it possible to increase the adjusting torque as required in a simple manner. It is thereby possible to reduce the use of pressure medium overall and to limit the power dissipation.

In an embodiment, a chamber which counteracts the pressure boost is connected directly to a reservoir for the pressure medium. In principle, the counter chamber assigned to the additional pressure chamber for the pressure boost is switched to an unpressurized state and connected to the reservoir for the pressure medium. This enables the pressure medium to flow into the counter chamber without pressurizing the counter chamber or being displaced out of said chamber. Via a direct, in particular a valve-free, connection between the counter chamber and the reservoir, particularly simple inflow and outflow is made possible. An additional pressure boost in the "retard" direction is generally not necessary since, in this case, the friction torques and drag torques of the camshaft assist adjustment in this adjustment direction.

In an embodiment, a volume flow of pressure medium made available by a pump for supplying pressure medium is divided by the control valve into a first partial flow and a second partial flow, wherein the first partial flow of the pressure medium is supplied to the first group of working chambers, and the second partial flow is supplied for the selectable pressure boost. Appropriate division of the volume flow via the control valve enables the pressure medium to be provided by a common pressure medium pump. In this case, the division of the volume flow can be implemented via an additional function of the control valve, thereby making it possible to implement the pressure boost with relatively small design changes to the hydraulic camshaft adjuster.

In an embodiment, a method for controlling a hydraulic camshaft adjuster is proposed, in which method an additional adjusting force is applied by the selection of an additional pressure booster when adjusting the rotor counter to the drag torques of the camshaft. The operating pressure of the hydraulic camshaft adjuster can be lowered at many operating points, resulting in less dissipation of the power of the pressure medium pump and, as a consequence, a higher efficiency of the internal combustion engine. Unproblematic adjustment, even against the friction torques and drag torques, is nevertheless achieved if the pressure boost is selected, and thus less pressure medium has to be provided for the same functionality, or a higher speed of adjustment can be achieved.

Unless stated otherwise in individual cases, the various embodiments of the disclosure which are mentioned in this application can advantageously be combined.

BRIEF DESCRIPTION OF THE DRAWINGS

Various embodiments are explained in greater detail below and the associated drawings. In the figures, components that are the same or components with the same function are denoted by the same reference signs. In the drawings.

DETAILED DESCRIPTION OF THE DRAWINGS

Figure 1:
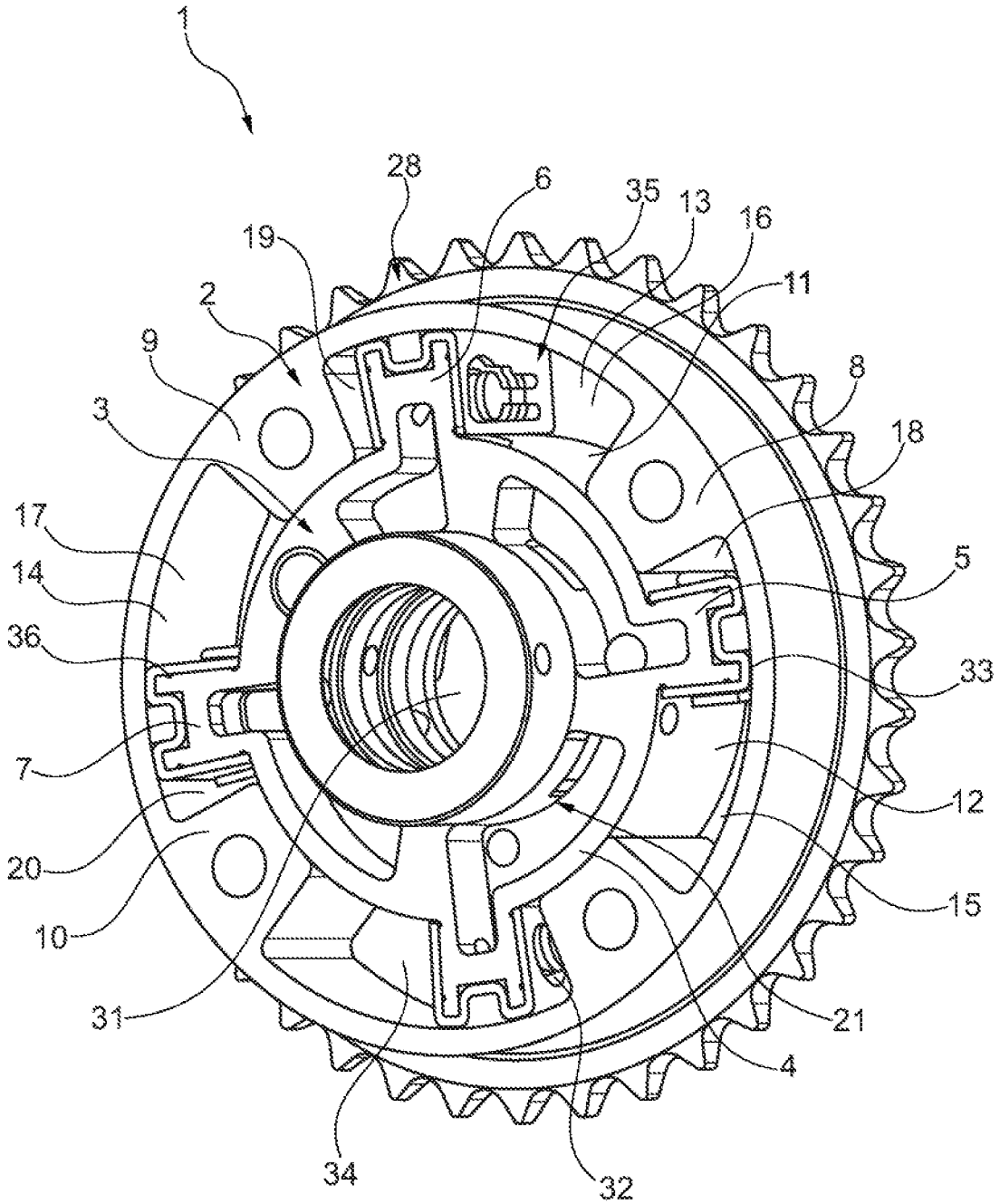
FIG. 1 shows an illustrative embodiment of a hydraulic camshaft adjuster in section.

FIG. 1 shows an illustrative embodiment of a hydraulic camshaft adjuster 1 according to an embodiment for adjusting the valve timings of an internal combustion engine. The hydraulic camshaft adjuster 1 illustrated schematically in FIG. 1 is designed as a vane-type adjuster and comprises a stator 2, which can be driven by a crankshaft (not illustrated) of an internal combustion engine, and a rotor 3, which can be connected for conjoint rotation to a camshaft (likewise not illustrated). The rotor 3 has a rotor hub 4, from which a plurality of vanes 5, 6, 7 extend in a radial direction. The stator 2 has a plurality of ribs 8, 9, 10, which divide an annular chamber 11 between the stator 2 and the rotor 3 into a plurality of pressure chambers 12, 13, 14. The pressure chambers 12, 13, 14 are divided by the vanes 5, 6, 7 of the rotor 3 into working chambers 15, 16, 17, 18, 19, 20. In addition to the working chambers 15, 16, 17, 18, 19, 20 known in the normal operation of the hydraulic camshaft adjuster 1, a working chamber 34 for the pressure boost 23 and a chamber 32 counteracting this additional working chamber 34 are formed between the rotor 3 and the stator. The working chamber 23 for the pressure boost 23 can therefore be referred to as a pressure boost working chamber. The rotor 3 has a pressure medium accumulator 21 for a pressure medium 22 for actuating the hydraulic camshaft adjuster 1, said accumulator being formed substantially in the rotor hub 4. The rotor 3 has a central opening 31, into which a central valve 24 for controlling the pressure medium supply to the working chambers 15, 16, 17, 18, 19, 20, 34 can be inserted. The pressure medium accumulator 21 is connected hydraulically to the working chambers 15, 16, 17, 18, 19, 20. In this case, check valves 33, 35, 36 are arranged in the vanes 5, 6, 7 of the rotor 3 in order to allow additional pressure medium 22 to flow in from the pressure medium accumulator 21 when there is a reduced pressure in one of the working chambers 15, 16, 17, 18, 19, 20.

Figure 2:
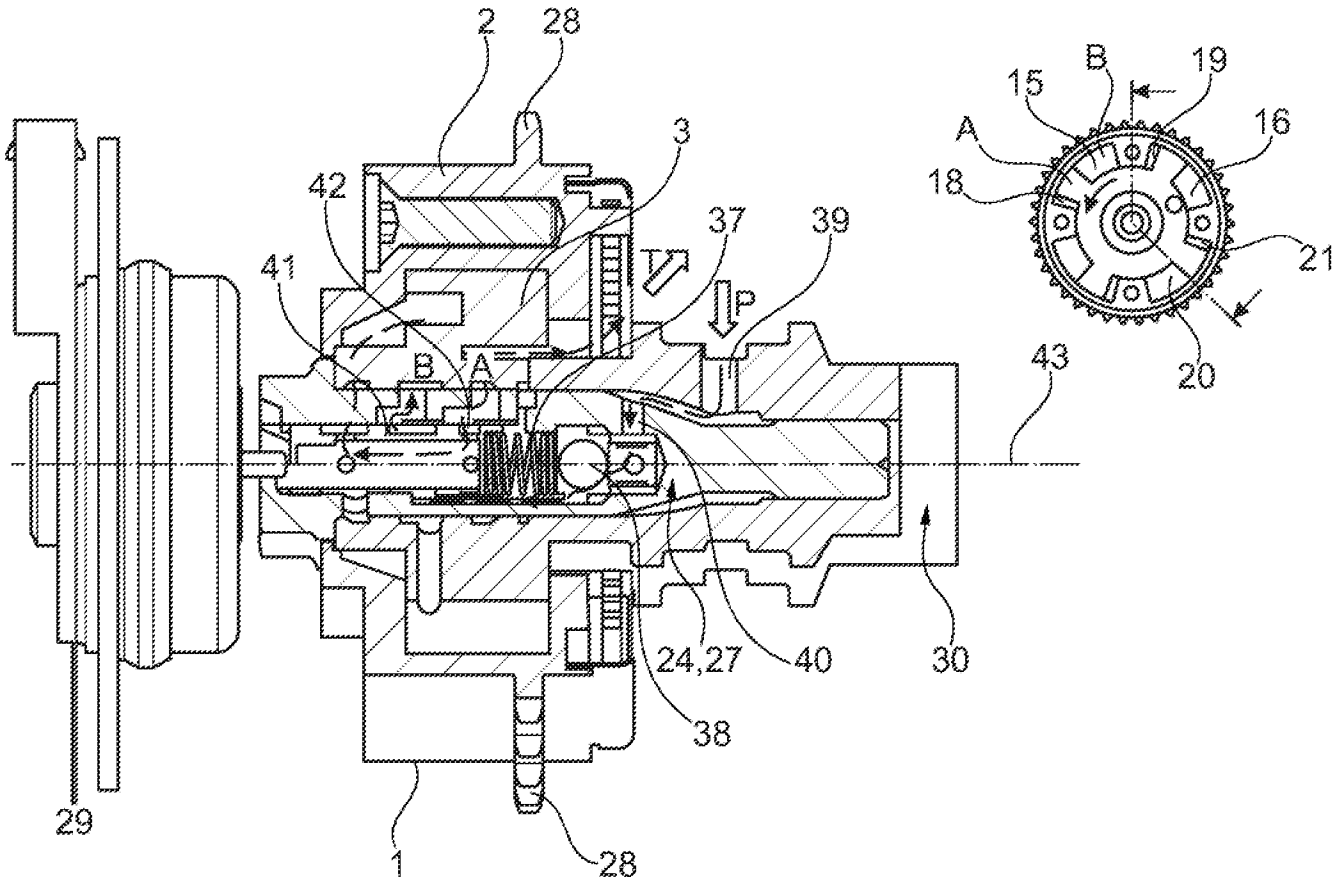
FIG. 2 shows a schematic illustration of a hydraulic camshaft adjuster intended to illustrate the pressure medium supply to the working chambers.

FIG. 2 illustrates a hydraulic camshaft adjuster 1 having a stator 2 and a rotor 3, which can be switched via actuator 29. Here, the rotor 3 is connected to a camshaft 30 for conjoint rotation therewith and is rotatable relative to the stator 2. In this arrangement, the central valve 24, as control valve 27, is moved in the central opening 31 of the rotor 3 in order in this way to control the pressure medium supply to the working chambers 15, 16, 17, 18, 19, 20. Here, the pressure medium is supplied via a pressure medium pump P (not illustrated) from a reservoir 26. In this case, the pressure medium 22, in particular an oil, is pumped through a feed bore 39 in the camshaft 30 and fed to the central valve 24 via another feed bore 40. Via the corresponding openings 41, 42 in the central valve 24, the oil feed passages in the rotor 3 can then be supplied with pressure medium 22. During this process, both the pressure medium accumulator 21 and the working chambers 15, 16, 17, 18, 19, 20 can be filled. By means of an actuation of the actuator 29, the central valve 24 can be moved along a central axis 43 and thus open or close the oil feed passages.

Figure 3:
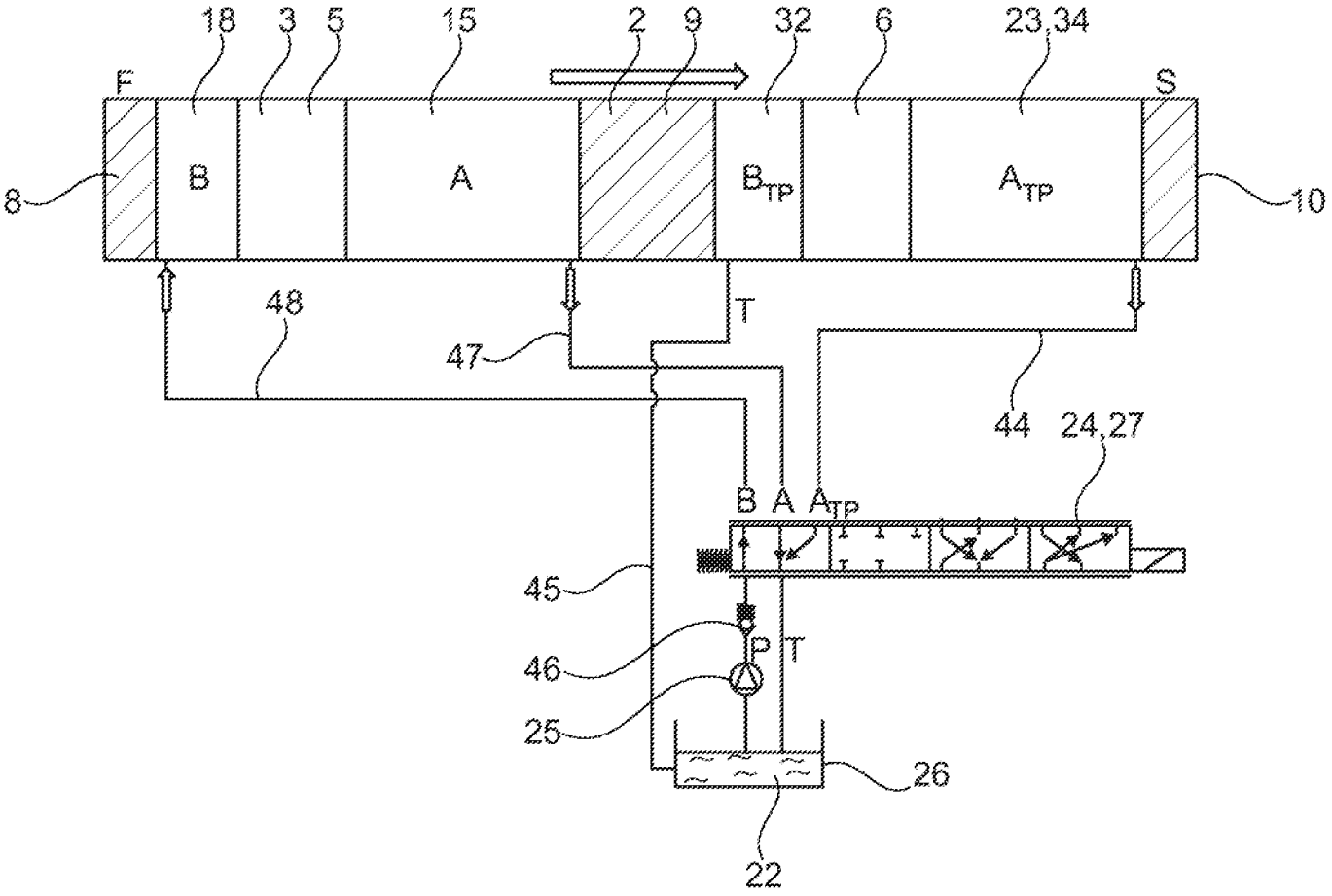
FIG. 3 shows the hydraulic camshaft adjuster in a case of a rotation of the rotor in the "retard" direction.

FIG. 3 illustrates a hydraulic camshaft adjuster 1 in a developed view. The hydraulic camshaft adjuster 1 has a stator 2 and a rotor 3. Working chambers 15, 18 are formed between the stator 2 and the rotor. FIG. 3 illustrates an adjustment of a hydraulic camshaft adjuster 1 according to an embodiment in the "retard" direction. In principle, the angle of rotation of the camshaft 30 with respect to the crankshaft is adjusted in the normal operation of the hydraulic camshaft adjuster 1 by supplying a first group of working chambers 15, 16, 17 with pressure medium and thereby enlarging the volume thereof, while the pressure medium is simultaneously displaced from a second group of working chambers 18, 19, 20 and the volume thereof is reduced. The working chambers 15, 16, 17, the volume of which is respectively increased as a group during this adjusting movement, are referred to in the sense as working chambers 15, 16, 17 of one effective direction, while the working chambers 18, 19, 20, the volume of which is simultaneously reduced, are referred to as working chambers of the opposite effective direction. The enlargement of the volume of working chambers 15, 16, 17 has the effect that the rotor 3 is rotated in the "advance" direction relative to the stator 2. An enlargement of the volume of working chambers 18, 19, 20 has the effect of adjusting the rotor 3 in the "retard" direction. In addition, the hydraulic camshaft adjuster 1 has a pressure boost 23, which comprises an additional working chamber 34 and a chamber 32 which counteracts the additional working chamber 34, said chambers likewise being separated by a vane 6 of the camshaft adjuster 1. In the case of an adjustment in the "retard" direction, this pressure boost 23 is not activated, and therefore the additional working chamber 34 and the oppositely acting chamber 32 are connected by oil supply lines 44, 45 to the reservoir 26. In this case, the central valve 24 is switched in such a way that the pressure medium 22 is delivered by the pressure medium pump 25 exclusively into the second group B of working chambers 18, 19, 20. A check valve 46 is provided between the pressure medium pump 25 and the central valve 24 in order to avoid a return flow of pressure medium 22 into the reservoir 26.

Figure 4:
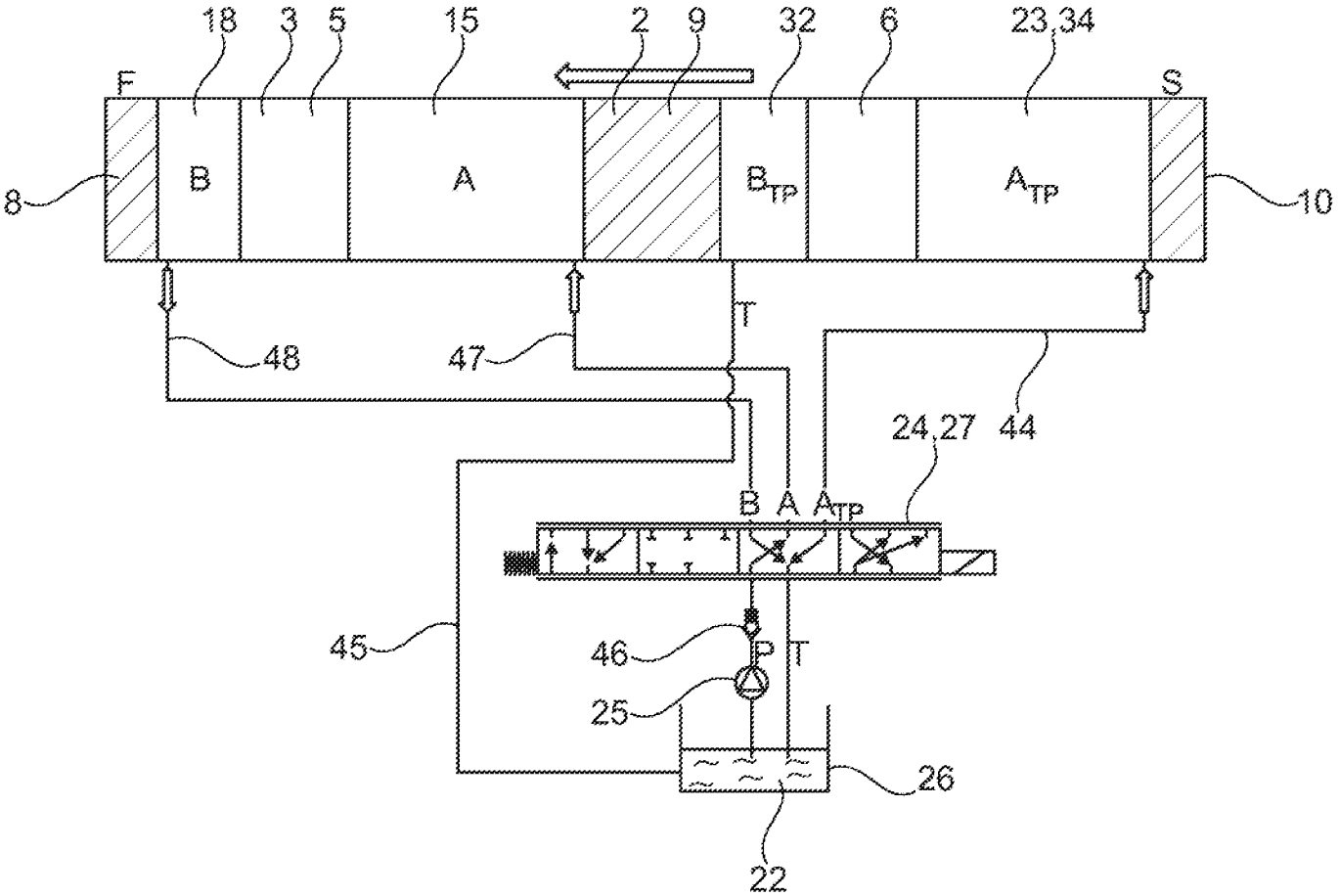
FIG. 4 shows the hydraulic camshaft adjuster in a case of a rotation of the rotor in the "advance" direction without a pressure booster.

FIG. 4 illustrates an adjustment of a hydraulic camshaft adjuster according to the embodiment in the "advance" direction without the use of the pressure booster 23. In this case, the pressure medium pump 25 is connected to the first group A of working chambers 15, 16, 17 via the central valve 24 and delivers the pressure medium 22 into this first group A of working chambers 15, 16, 17. Here, the volume of the first group A of working chambers 15, 16, 17 is enlarged and, in parallel, the volume of the second group B of working chambers is reduced, as a result of which the rotor is adjusted in the "advance" direction. During this process, the additional working chamber 34 of the pressure boost 23 and the chamber 32 is switched to an unpressurized state, as with an adjustment in the "retard" direction, and is connected by the oil supply lines 44, 45 to the reservoir 26.

Figure 5:
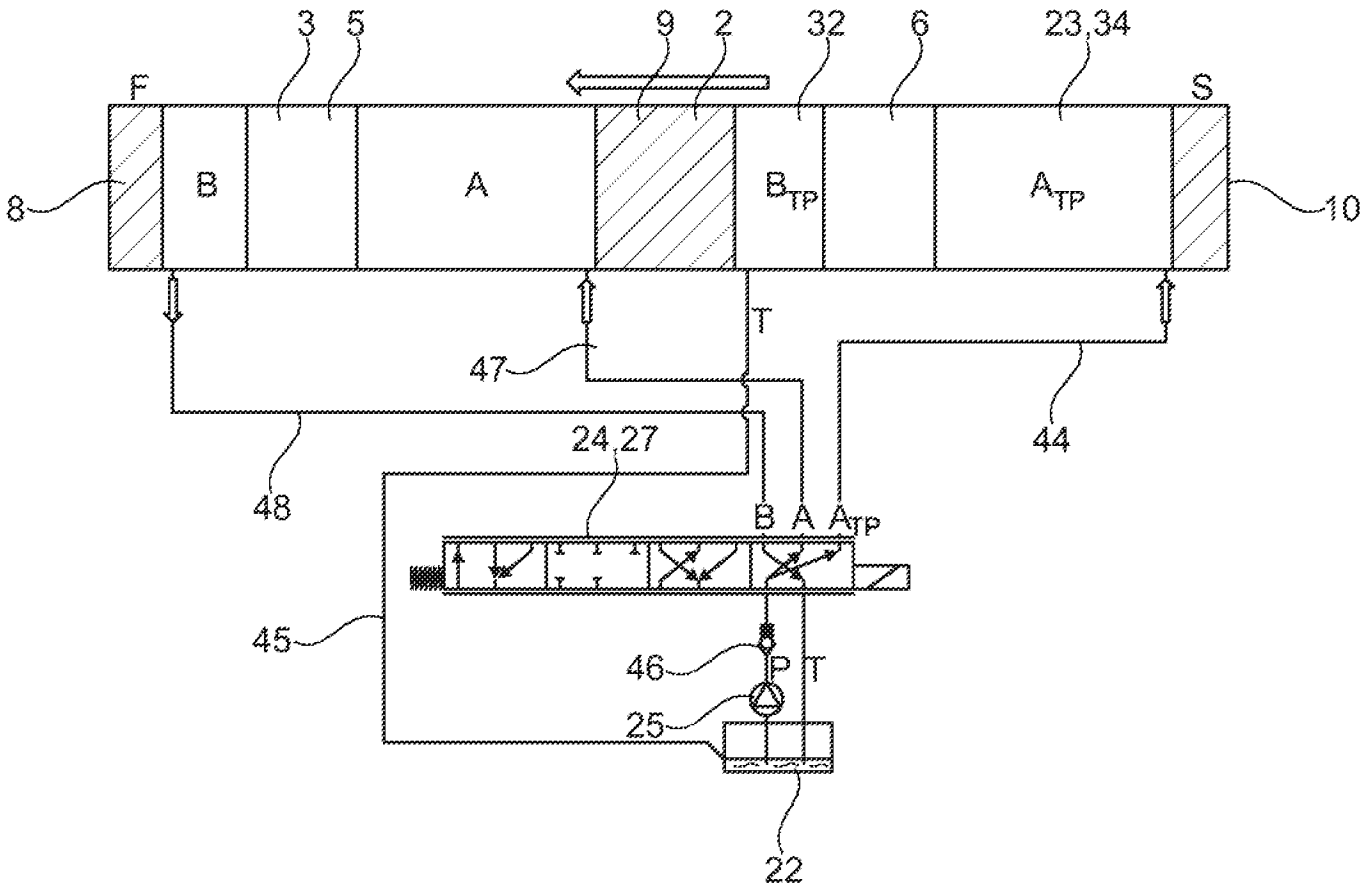
FIG. 5 shows the hydraulic camshaft adjuster in a case of a rotation of the rotor in the "advance" direction with the addition of the pressure booster.

FIG. 5 illustrates an adjustment of the rotor 3 counter to the friction and drag torques of the camshaft 30. Here, the pressure boost 23 is configured in such a way that the maximum friction torque to be expected can be overcome to ensure an adjustment in the "advance" direction at the minimum pump pressure of the pressure medium pump 25. As described with respect to FIG. 3, the adjustment in the "retard" direction is generally uncritical since, in this case, the friction torques assist with the adjustment. However, an adjustment in the "advance" direction requires a higher adjusting torque since, in this case, the friction torque has to be overcome in addition. This is especially the case when the internal combustion engine is being operated with a reduced valve travel. For this purpose, a pressure boost 23 is implemented via the central valve 24, with an additional working chamber 34 being supplied with pressure and thus the hydraulically effective area at the vanes 5, 6 of the rotor being enlarged. During this process, the volume flow of the pressure medium 22 is divided by the central valve 24 into a first partial flow and a second partial flow, wherein the first partial flow is fed to the first group A of working chambers 15, 16, 17 via the oil supply passage 47, and the second partial flow is fed to the additional working chamber 34 of the pressure boost 23 via the oil supply passage 44. An additional vane 6 of the rotor 3 is thereby subjected to pressure, as a result of which the adjusting torque in the "advance" direction is increased. Alternatively, it is also possible for a plurality of additional working chambers 34 to be activated by the second partial flow, thereby making possible a corresponding adaptation of the boost ratio of the pressure boost 23.

The selection of the additional working chamber 34, which assists an adjustment in the "advance" direction, is made possible via an additional switching position at the central valve 24. For this purpose, one or more additional openings are required in the central valve. In principle, the counter chamber 32 associated with the additional working chamber 34 is switched to an unpressurized state and connected to the reservoir 26. It represents a compensating volume and does not exert any force on the rotor 3 in normal operation. It is assumed that the hydraulic camshaft adjuster 1 is designed in such a way that an additional pressure boost in the "retard" direction is not necessary and that this is accomplished solely by pressurization of the second group B of working chambers 18, 19, 20.

In the case of a hydraulic camshaft adjuster 1 according to the teachings herein, it is thus possible to adjust the rotor 3 in the "advance" direction counter to the friction and drag torques and using the selectable pressure boost 23, wherein the pressure medium throughput and the associated power dissipation is reduced as compared with the hydraulic camshaft adjusters 1 known from the prior art. It is thereby possible to increase the efficiency of the internal combustion engine and to reduce consumption.

LIST OF REFERENCE SIGNS

1 hydraulic camshaft adjuster
2 stator
3 rotor
4 rotor hub
5 vane
6 vane
7 vane
8 rib
9 rib
10 rib
11 annular chamber
12 pressure chamber
13 pressure chamber
14 pressure chamber
15 working chamber
16 working chamber
17 working chamber
18 working chamber
19 working chamber
20 working chamber
21 pressure medium accumulator
22 pressure medium
23 selectable pressure boost
24 central valve
25 pressure medium pump
26 reservoir
27 control valve
28 drive toothing
29 actuator
30 camshaft
31 central opening
32 chamber
33 check valve
34 working chamber
35 check valve
36 check valve
37 valve spring
38 valve ball
39 feed bore
40 feed bore
41 opening (in the central valve)
42 opening (in the central valve)
43 central axis
44 oil supply passage
45 oil supply passage
46 check valve
47 oil supply passage
48 oil supply passage

The invention claimed is:

1. A hydraulic camshaft adjuster for adjusting timings of gas exchange valves of an internal combustion engine, the hydraulic camshaft adjuster comprising:

a stator configured to rotate synchronously with a crankshaft of the internal combustion engine, a rotor arranged within the stator so as to rotate relative to the stator, the rotor configured to rotate synchronously with a camshaft, and a plurality of ribs extending radially inwardly from the stator, the plurality of ribs dividing an annular chamber between the stator and the rotor into a plurality of pressure chambers, wherein the rotor has a rotor hub and a plurality of vanes extending radially outwardly from the rotor hub, the plurality of vanes dividing the plurality of pressure chambers into respective first and second groups of working chambers, which have opposing effective directions and the first and second groups of working chambers are each supplied with a pressure medium flowing in or out in a pressure medium circuit, and having a pressure medium accumulator configured to store the pressure medium, wherein an additional working chamber serves as a selectable pressure boost configured to act on a dedicated vane of the plurality of vanes so as to selectively assist the first group of working chambers in a first direction, in which the pressure medium supplied to the selectable pressure boost rotates the rotor relative to the stator, such that:

in a first operating state, the first group of working chambers, excluding the additional working chamber, is configured to receive the pressure medium so as to move the rotor in the first direction, in a second operating state, the additional working chamber, in addition to the first group of working chambers, is configured to receive the pressure medium so as to move the rotor in the first direction, and in a third operating state, the second group of working chambers is configured to receive the pressure medium so as to move the rotor in a second direction, and wherein the hydraulic camshaft adjuster further comprises a single control valve configured to control the first, second, and third operating states.

2. The hydraulic camshaft adjuster as claimed in claim 1, wherein the control valve is a central valve arranged in a central opening of the rotor.

3. The hydraulic camshaft adjuster as claimed in claim 1, wherein the selectable pressure boost is configured to provide an adjusting force in precisely one effective direction oriented counter to an effective direction of drag torques of the camshaft.

4. The hydraulic camshaft adjuster as claimed in claim 1, wherein a volume flow of the pressure medium caused by a pressure medium pump configured to supply the pressure medium is divided by the control valve into a first partial flow and a second partial flow, wherein the first partial flow of the pressure medium is supplied to the first group of working chambers, and the second partial flow is supplied to the selectable pressure boost.

5. The hydraulic camshaft adjuster as claimed in claim 1, wherein the hydraulic camshaft adjuster is connected to a variable valve train of an internal combustion engine.

6. A hydraulic camshaft adjuster comprising:

a stator configured to rotate synchronously with a crankshaft of an internal combustion engine, the stator having a plurality of radially inwardly-extending ribs;

a rotor arranged within the stator so as to rotate relative to the stator, the rotor configured to rotate synchronously with a camshaft, the rotor having a rotor hub and a plurality of vanes extending radially outwardly from the rotor hub, wherein an annular chamber is defined between the rotor and the stator, and the plurality of radially inwardly-extending ribs divides the annular chamber into a plurality of pressure chambers, and the plurality of vanes divides the plurality of pressure chambers into a plurality of working chambers configured to selectively rotate the rotor relative to the stator when provided with hydraulic pressure via a pressure medium circuit, wherein one working chamber of the plurality of working chambers is a pressure boost working chamber configured to act on a dedicated vane of the plurality of vanes; and a single control valve coupled to the pressure medium circuit, the control valve operable in (i) a first operating state which forces the rotor in a first rotational direction in which a first group of working chambers of the plurality of working chambers, excluding the pressure boost working chamber, is configured to be provided with the hydraulic pressure, (ii) a second operating state which forces the rotor in the first rotational direction in which the pressure boost working chamber, in addition to the first group of working chambers, is configured to be provided with the hydraulic pressure, and (iii) a third operating state in which a second group of working chambers of the plurality of working chambers is configured to be provided with the hydraulic pressure so as to force the rotor in a second rotational direction.

7. The hydraulic camshaft adjuster of claim 6, further comprising a pump configured to provide the hydraulic pressure.

8. The hydraulic camshaft adjuster of claim 6, wherein the control valve is a central valve arranged in a central opening of the rotor.

9. The hydraulic camshaft adjuster of claim 6, wherein in the second operating state, the pressure boost working chamber provides an additional pressure boost so as to apply an adjusting force in precisely one effective direction oriented counter to an effective direction of drag torques of the camshaft.

10. A hydraulic camshaft adjuster comprising:

a stator configured to rotate synchronously with a crankshaft of an internal combustion engine, the stator having a plurality of radially inwardly-extending ribs;

a rotor arranged within the stator so as to rotate relative to the stator, the rotor configured to rotate synchronously with a camshaft, the rotor having a rotor hub and a plurality of vanes extending radially outwardly from the rotor hub;

a plurality of pressure chambers between the stator and the rotor configured to selectively rotate the rotor relative to the stator;

an additional pressure chamber serving as a pressure boost chamber configured to act on a dedicated vane of the plurality of vanes so as to selectively rotate the rotor in a first rotational direction relative to the stator; and a single control valve coupled to a pressure medium circuit, the control valve operable in (i) a first operating state which forces the rotor in the first rotational direction in which the plurality of pressure chambers, excluding the pressure boost chamber is configured to receive hydraulic pressure from a pump, (ii) a second operating state which forces the rotor in the first rotational direction in which the pressure boost chamber, in addition to the plurality of pressure chambers, is configured to receive the hydraulic pressure from the pump, and (iii) a third operating state in which the plurality of pressure chambers is configured to receive the hydraulic pressure from the pump so as to force the rotor in a second rotational direction relative to the stator.

* * * * *